US012791236B2

(12) United States Patent
Oh et al.

(10) Patent No.: US 12,791,236 B2
(45) Date of Patent: Nov. 10, 2026

(54) HEAT SUPPLIER AND METHOD FOR CONTROLLING HEAT SUPPLIER

(71) Applicant: LG ELECTRONICS INC., Seoul (KR)

(72) Inventors: Seungtaek Oh, Seoul (KR); Doyong Ha, Seoul (KR); Jeongseob Shin, Seoul (KR); Sangil Park, Seoul (KR); Soojin Kang, Seoul (KR); Hyunjong Kim, Seoul (KR); Kyongmin Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 114 days.

(21) Appl. No.: 18/779,238

(22) Filed: Jul. 22, 2024

(65) Prior Publication Data

US 2025/0035351 A1 Jan. 30, 2025

(30) Foreign Application Priority Data

Jul. 24, 2023 (KR) ..... 10-2023-0096327

(51) Int. Cl.
*F25B 41/20* (2021.01)
*F25B 30/02* (2006.01)

(52) U.S. Cl.
CPC ..... *F25B 41/20* (2021.01); *F25B 30/02* (2013.01); *F25B 2600/2513* (2013.01)

(58) Field of Classification Search
CPC ..... F25B 41/20; F25B 47/022; F25B 30/02; F25B 41/385; F25B 2313/003; F25B 13/00
See application file for complete search history.

(56) References Cited

U.S. PATENT DOCUMENTS

2007/0068178 A1 3/2007 Honma et al.
2014/0345310 A1* 11/2014 Tamaki ..... F25B 41/39 62/238.6

(Continued)

FOREIGN PATENT DOCUMENTS

CN 214307714 U * 9/2021
EP 2 940 407 11/2015

(Continued)

OTHER PUBLICATIONS

Korean Office Action dated Aug. 14, 2025, issued in Application No. 10-2023-0096327.

(Continued)

*Primary Examiner* — Frantz F Jules
*Assistant Examiner* — Martha Tadesse
(74) *Attorney, Agent, or Firm* — KED & ASSOCIATES

(57) ABSTRACT

A heat supplier may include a compressor that compresses a refrigerant; a first heat exchanger that exchanges heat between air and the refrigerant; a second heat exchanger that exchanges heat between a fluid and the refrigerant; a switching valve that directs the refrigerant discharged from the compressor into the first heat exchanger or the second heat exchanger; a first liquid pipe that connects the first heat exchanger and the second heat exchanger; a second liquid pipe connected in parallel to the first liquid pipe so as to connect the first heat exchanger and the second heat exchanger; a first expansion valve disposed at the first liquid pipe and configured to expand refrigerant flowing therethrough; and a second expansion valve disposed at the second liquid pipe and configured to expand refrigerant flowing therethrough. A size of an aperture of the second expansion valve may be greater than a size of an aperture of the first expansion valve, enabling a flow rate of refrigerant to be adjusted according to an operation mode.

12 Claims, 11 Drawing Sheets

(56) References Cited

U.S. PATENT DOCUMENTS

| | | | | |
|---|---|---|---|---|
| 2018/0252449 | A1* | 9/2018 | Ito | F25B 41/20 |
| 2022/0221203 | A1 | 7/2022 | Kanagala et al. | |

FOREIGN PATENT DOCUMENTS

| | | | |
|---|---|---|---|
| JP | 2003-214729 | | 7/2003 |
| JP | 2009-186057 | | 8/2009 |
| JP | 2015021680 | A * | 2/2015 |
| KR | 10-2004-0086294 | | 10/2004 |
| WO | WO 2011/010473 | | 1/2011 |
| WO | WO 2011/092802 | | 8/2011 |

OTHER PUBLICATIONS

European Search Report issued in Application No. 24190028.1 dated Nov. 6, 2024.

* cited by examiner

HEAT SUPPLIER AND METHOD FOR CONTROLLING HEAT SUPPLIER

CROSS-REFERENCE TO RELATED APPLICATION(S)

This application claims priority under 35 U.S.C. § 119 to Korean Application No. 10-2023-0096327 filed in Korea on Jul. 24, 2023, whose entire disclosure is hereby incorporated by reference.

BACKGROUND

1. Field

A heat supplier and a method for controlling a heat supplier are disclosed herein.

2. Background

A heat supplier is a device that supplies heating or cooling energy to water flowing into an indoor space. Such a heat supplier may have a structure that includes a compressor, a first heat exchanger for heat exchange between air and refrigerant, and a second heat exchanger for heat exchange between water supplied to an indoor space and refrigerant. In other words, the heat supplier may use an air-to-water heat pump (AWHP) that uses refrigerant to exchange heat between air and water. The water flowing through the second heat exchanger may receive heating or cooling energy of the refrigerant to be supplied to the indoor space.

The heat supplier may be mainly operated in a heating operation mode in which refrigerant at a high pressure is delivered to the second heat exchanger. However, depending on the condition, the heat supplier may be operated in a cooling operation mode in which liquid refrigerant is delivered to the second heat exchanger.

A capacity difference occurs between the first heat exchanger, which performs heat exchange between air and refrigerant, and the second heat exchanger, which performs heat exchange between water and refrigerant. In general, the capacity of the first heat exchanger is greater than the capacity of the second heat exchanger. This may cause a difference in a flow rate of the refrigerant between when the heat supplier is operated in the heating operation mode and when the heat supplier is operated in the cooling operation mode. In addition, when the heat supplier is used in cold regions, frost may be formed on the first heat exchanger, and water supplied to the second heat exchanger may fall below a certain level in an extremely low-temperature environment.

European Patent No. 2015/2940407B, which is hereby incorporated by reference, discloses a typical AWHP cycle in which one expansion valve is disposed between a first heat exchanger that exchanges heat between air and refrigerant and a second heat exchanger that exchanges water supplied to an indoor space and refrigerant. Such a structure is disadvantageous to control the difference in flow rate caused by the change of mode between the cooling operation mode and the heating operation mode. Further, in an extremely low-temperature environment, even when water introduced into the second heat exchanger is maintained below a certain level, there is no way to control this problem.

BRIEF DESCRIPTION OF THE DRAWINGS

Embodiments will be described in detail with reference to the following drawings in which like reference numerals refer to like elements, and wherein.

DETAILED DESCRIPTION

Figure 1:
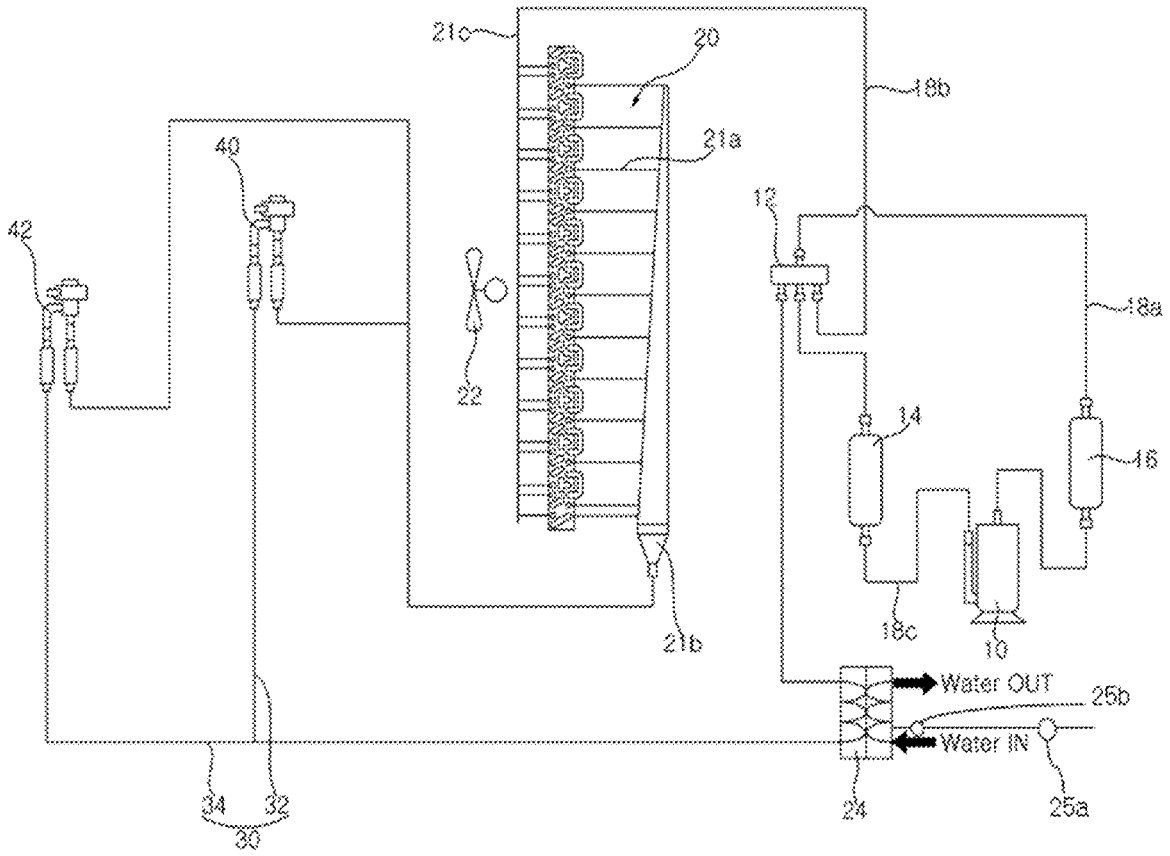
FIG. 1 is a schematic diagram of a heat supplier according to an embodiment.

The above and other aspects, features and other advantages will be more clearly understood from the following description taken in conjunction with the accompanying drawings. Exemplary embodiments will now be described more fully hereinafter with reference to the accompanying drawings; however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Hereinafter, a heat supplier according to embodiments will be described with reference to the accompanying drawings.

The heat supplier according to embodiments disclosed herein may provide heating or cooling to an indoor space. The heat supplier may supply a high pressure refrigerant or a low pressure refrigerant to a second heat exchanger 24 (see FIG. 1) described hereinafter, so as to supply heating or cooling energy to water flowing into the indoor space.

With reference to FIG. 1, components provided in an outdoor unit of the heat supplier will be described hereinafter.

The heat supplier may include a compressor 10 to compress refrigerant, a first heat exchanger 20 for heat exchange between the refrigerant discharged from the compressor 10 and air, the second heat exchanger 24 for heat exchange between the refrigerant discharged from the compressor 10 and a fluid, such as water, and a switching valve 12 to direct the refrigerant discharged from the compressor 10 into the first heat exchanger 20 or the second heat exchanger 24. The heat supplier may further include a heat exchanger fan 22 to cause air to flow into the first heat exchanger 20.

The first heat exchanger 20 exchanges heat between air and refrigerant. Referring to FIG. 1, the first heat exchanger 20 may include a plurality of branch refrigerant tubes 21*a*, a heat exchanger header 21*b* that connects one side (or a first side) of each of the plurality of branch refrigerant tubes 21*a* and a liquid pipe 30 described hereinafter, and a manifold 21*c* that connects the other side (or a second side) of each of the plurality of branch refrigerant tubes 21*a* and a gas pipe 18*b*.

The heat exchanger fan 22 may cause an air flow into the first heat exchanger 20. Thus, as the heat exchanger fan 22 operates, it greatly increases the air flow rate, causing the refrigerant flowing in the first heat exchanger 20 to undergo a phase change.

The second heat exchanger 24 exchanges heat between a fluid, such as water, and refrigerant. The second heat exchanger 24 may be a plate type heat exchanger. The heat exchanger 24 is provided with a flow path in which a fluid, such as water, flows and a flow path in which refrigerant flows. The refrigerant flowing in the second heat exchanger 24 may exchange heat with a fluid, such as water, causing the refrigerant to undergo a phase change. Fluid, such as water introduced into the second heat exchanger 24 may be moved by a pump (25*a*) disposed at one side.

The switching valve 12 may direct the flow of refrigerant discharged from the compressor 10 into the first heat exchanger 20 or the second heat exchanger 24. When an operation mode of the heat supplier is switched, the switching valve 12 may change a flow direction of the refrigerant discharged from the compressor 10.

The heat supplier may include an accumulator 14 that separates the refrigerant flowing to the compressor 10 into liquid refrigerant and gaseous refrigerant so as to supply the gaseous refrigerant to the compressor 10. The heat supplier may include a muffler 16 to reduce noise of the refrigerant discharged from the compressor 10.

The heat supplier may include a liquid pipe 30 that connects the first heat exchanger 20 and the second heat exchanger 24.

The heat supplier may include a first expansion valve 40 to expand the refrigerant flowing from the second heat exchanger 24 to the first heat exchanger 20. The heat supplier may include a second expansion valve 42 to expand the refrigerant flowing from the first heat exchanger 20 to the second heat exchanger 24.

The liquid pipe 30 may include a first liquid pipe 32 at which the first expansion valve 40 is disposed, and a second liquid pipe 34 at which the second expansion valve 42 is disposed. The first liquid pipe 32 may connect the first heat exchanger 20 and the second heat exchanger 24. The first expansion valve 40 may be disposed at the first liquid pipe 32. Both ends of the second liquid pipe 34 may be connected to the first liquid pipe 32.

A size of an aperture of the second expansion valve 42 may be greater than a size of an aperture of the first expansion valve 40. The size of the aperture of the expansion valve may refer to a size of an inner orifice defined when the expansion valve is opened to a maximum. A flow rate of the expansion valve may vary depending on the aperture size. Thus, when the second expansion valve 42 having a relatively larger aperture size is opened, the flow rate of refrigerant flowing through the first liquid pipe 32 or the second liquid pipe 34 may be increased compared to when the first expansion valve 40 is opened.

A size of an aperture of the second liquid pipe 34 may be greater than a size of an aperture of the first liquid pipe 32.

The heat supplier may include a high pressure pipe 18*a* through which the refrigerant discharged from the compressor 10 flows, first gas pipe 18*b* that connects the switching valve 12 and the first heat exchanger 20, and second gas pipe 18*c* that connects the switching valve 12 and the second heat exchanger 24.

Hereinafter, a refrigerant flow in a heating operation mode (HM), a cooling operation mode (CM), a first defrosting operation mode (DM1), and a second defrosting operation mode (DM2) of the heat supplier and a configuration of components will be described with reference to FIGS. 2 to 5.

The heat supplier according to embodiments may operate in a heating operation mode HM and a cooling operation mode CM. The heat supplier according to embodiments may operate in a first defrosting operation mode DM1 and a second defrosting operation mode DM2.

The heating operation mode HM is an operation method that heats a fluid, such as water, flowing through the second heat exchanger 24 by transferring refrigerant at a high pressure to the second heat exchanger 24. The cooling operation mode CM is an operation method that cools a fluid, such as water, flowing through the second heat exchanger 24 by transferring refrigerant at a high pressure to the first heat exchanger 20.

The first defrosting operation mode DM1 is an operation method that heats the first heat exchanger 20 by transferring refrigerant at a high pressure to the first heat exchanger 20. Frost, for example, formed on the first heat exchanger 20 may be removed through the first defrosting operation mode DM1.

The second defrosting operation mode DM2 is an operation method that heats the second heat exchanger 24 by transferring refrigerant at a high pressure to the second heat exchanger 24. Fluid, such as water, present in the second heat exchanger 24 may be heated through the second defrosting operation mode DM2.

Figure 2:
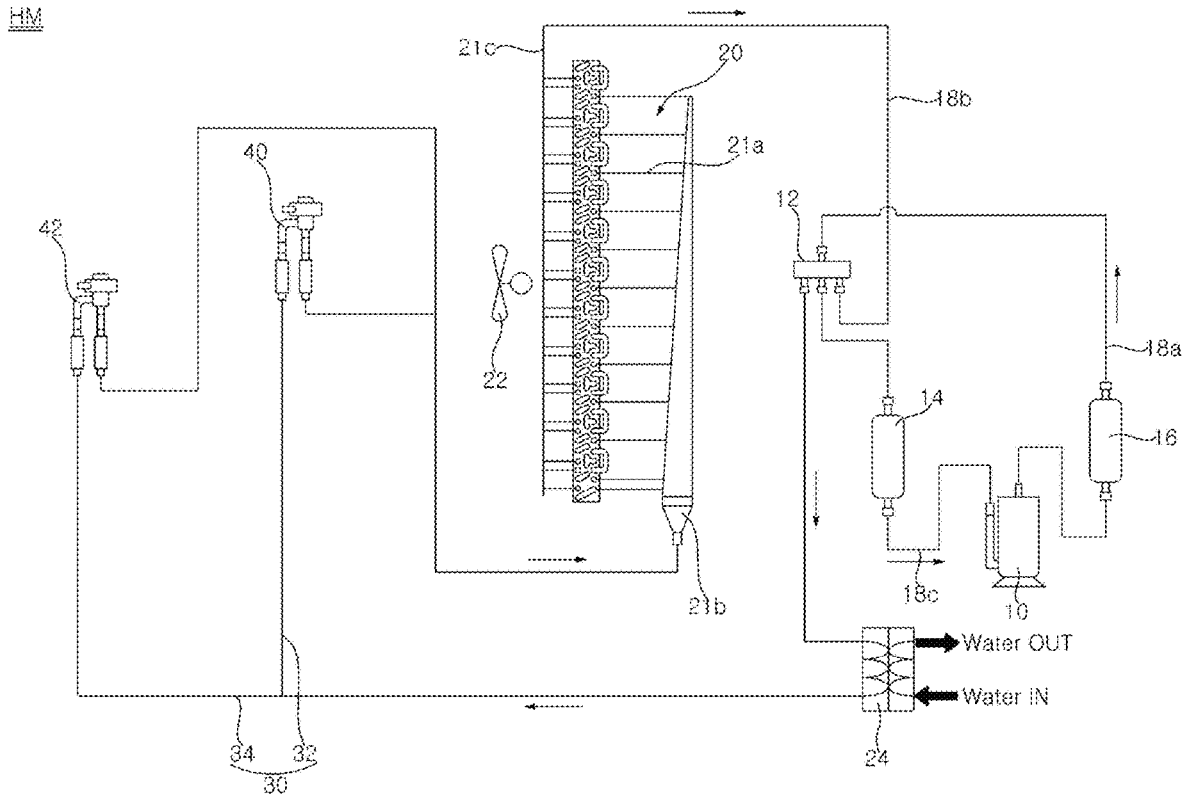
FIG. 2 is a schematic diagram for explaining a refrigerant flow in a heating operation mode of a heat supplier according to an embodiment.

Referring to FIG. 2, in the heating operation mode HM, the switching valve 12 may direct the refrigerant discharged from the compressor 10 into the second heat exchanger 24. The first expansion valve 40 may be controlled or adjusted to expand the refrigerant flowing through the first liquid pipe 32. The second expansion valve 42 is adjusted so that the refrigerant does not flow into the second liquid pipe 34. In the heating operation mode HM, the first heat exchanger 20 serves as an evaporator and the second heat exchanger 24 serves as a condenser.

Referring to FIG. 2, the refrigerant discharged from the compressor 10 may flow into the second heat exchanger 24 so as to heat a fluid, such as water. The refrigerant flowing out from the second heat exchanger 24 flows along the first liquid pipe 32. The refrigerant flowing along the first liquid pipe 32 may be expanded while passing through the first expansion valve 40. The refrigerant that has passed through the first expansion valve 40 may flow into the first heat exchanger 20, thereby exchanging heat with air. The refrigerant flowing out from the first heat exchanger 20 may flow through the switching valve 12, into the accumulator 14 and to the compressor 10.

In the heating operation mode HM, the refrigerant may heat the water flowing through the second heat exchanger 24. The refrigerant flowing out from the second heat exchanger 24 may be expanded while passing through the first expansion valve 40 and then flow into the first heat exchanger 20. As the second expansion valve 42 closes the second liquid pipe 34, no refrigerant flows into the second liquid pipe 34.

Figure 3:
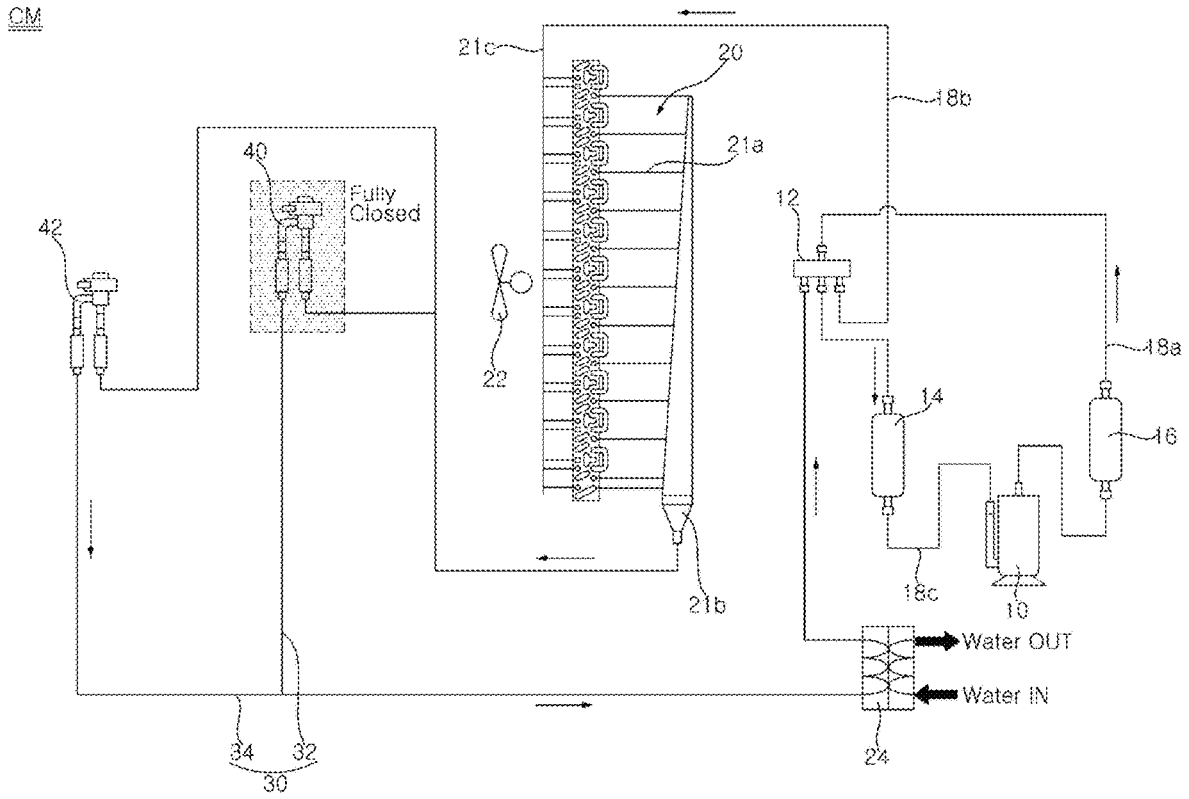
FIG. 3 is a schematic diagram for explaining a refrigerant flow in a cooling operation mode of a heat supplier according to an embodiment.

Referring to FIG. 3, in the cooling operation mode CM, the switching valve 12 may direct the refrigerant discharged from the compressor 10 into the first heat exchanger 20. The second expansion valve 42 may be controlled or adjusted to expand the refrigerant flowing through the second liquid pipe 34. The first expansion valve 40 may be adjusted so that the refrigerant does not flow into the first liquid pipe 32. In the cooling operation mode CM, the first heat exchanger 20 serves as a condenser and the second heat exchanger 24 serves as an evaporator.

Referring to FIG. 3, the refrigerant discharged from the compressor 10 may flow into the first heat exchanger 20 to heat air and cool the fluid, such as water flowing through the second heat exchanger 24. The refrigerant flowing along the second liquid pipe 34 may be expanded while passing through the second expansion valve 42. The refrigerant that has passed through the second expansion valve 42 may flow into the second heat exchanger 24, thereby exchanging heat with the water. The refrigerant flowing out from the second heat exchanger 24 may flow through the switching valve 12, into the accumulator 14 and to the compressor 10.

In the cooling operation mode CM, the refrigerant may cool the fluid, such as water, flowing through the second heat exchanger 24. The refrigerant flowing out from the first heat exchanger 20 may be expanded while passing through the second expansion valve 42 and then flow into the second heat exchanger 24. As the first expansion valve 40 closes the first liquid pipe 32, no refrigerant flows into the first liquid pipe 32.

Referring to FIGS. 2 and 3, in the cooling operation mode CM, the refrigerant discharged from the compressor 10 flows into the first heat exchanger 20 that exchanges heat between air and refrigerant. In the heating operation mode HM, the refrigerant discharged from the compressor 10 flows into the second heat exchanger 24 that exchanges heat between a fluid, such as water, and refrigerant.

As the first heat exchanger 20 exchanges heat between air and refrigerant, the refrigerant flows through the plurality of branch refrigerant tubes 21*a*. In other words, a flow area of refrigerant is larger in the first heat exchanger 20 than in the second heat exchanger 24. Accordingly, when the refrigerant discharged from the compressor 10 flows to the first heat exchanger 20, it requires a relatively large amount of refrigerant.

In embodiments disclose herein, as the size of the aperture of the second expansion valve 42 is greater than the size of the aperture of the first expansion valve 40, it is possible to increase the amount of refrigerant flowing in the cooling operation mode CM. That is, as shown in FIG. 2, in the heating operation mode HM, the refrigerant discharged from the second heat exchanger 24 is directed to flow into the first heat exchanger 20 through the first expansion valve 40 to thereby reduce the amount of refrigerant, whereas in the cooling operation mode CM, the refrigerant discharged from the first heat exchanger 20 is directed to flow into the second heat exchanger 24 through the second expansion valve 42 to thereby increase the amount of refrigerant.

Hereinafter, a defrosting operation mode will be described with reference to FIGS. 4 and 5.

The heat supplier according to embodiments may include the first defrosting operation mode DM1 in which the refrigerant discharged from the compressor 10 is delivered to the first heat exchanger 20, and the second defrosting operation mode DM2 in which the refrigerant discharged from the compressor 10 is delivered to the first heat exchanger 20 through the second heat exchanger 24. With reference to FIG. 4, the first defrosting operation mode DM will be described hereinafter.

Figure 4:
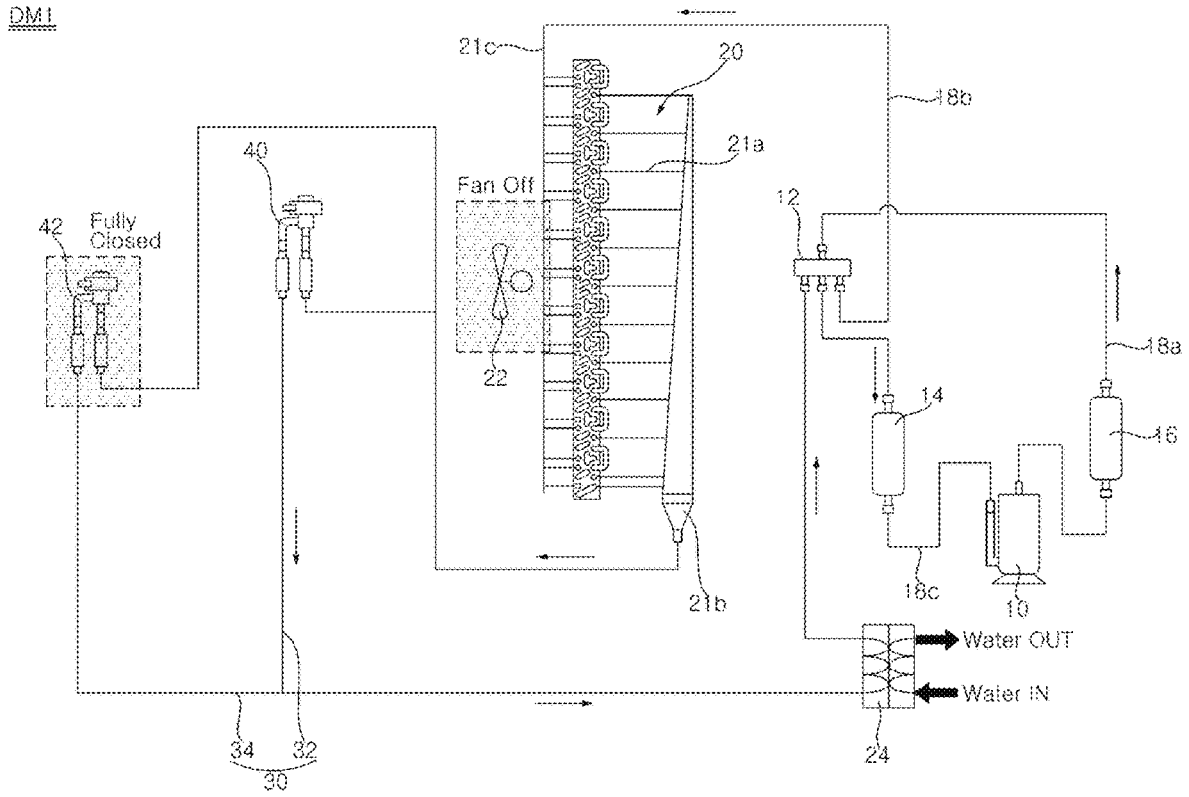
FIG. 4 is a schematic diagram for explaining a refrigerant flow in a first defrosting operation mode of a heat supplier according to an embodiment.

Referring to FIG. 4, in the first defrosting operation mode DM1, the switching valve 12 may direct the refrigerant discharged from the compressor 10 into the first heat exchanger 20. The high-temperature and high-pressure refrigerant discharged from the compressor 10 may be supplied directly to the first heat exchanger 20, thereby allowing frost, for example, formed on the first heat exchanger 20 to be removed.

In the first defrosting operation mode DM1, the first expansion valve 40 may be adjusted to expand the refrigerant flowing through the first liquid pipe 32. The second expansion valve 42 may be adjusted so that the refrigerant does not flow into the second liquid pipe 34. As the first defrosting operation mode DM1 is often performed during the heating operation mode HM, the first expansion valve 40, opened in the heating operation mode HM, may be kept open.

The heat exchanger fan 22 does not operate (that is, is turned off) in the first defrosting operation mode DM1. In the first defrosting operation mode DM1, a pump (not shown) may operate so that a fluid, such as water, flows into the second heat exchanger 24.

Figure 5:
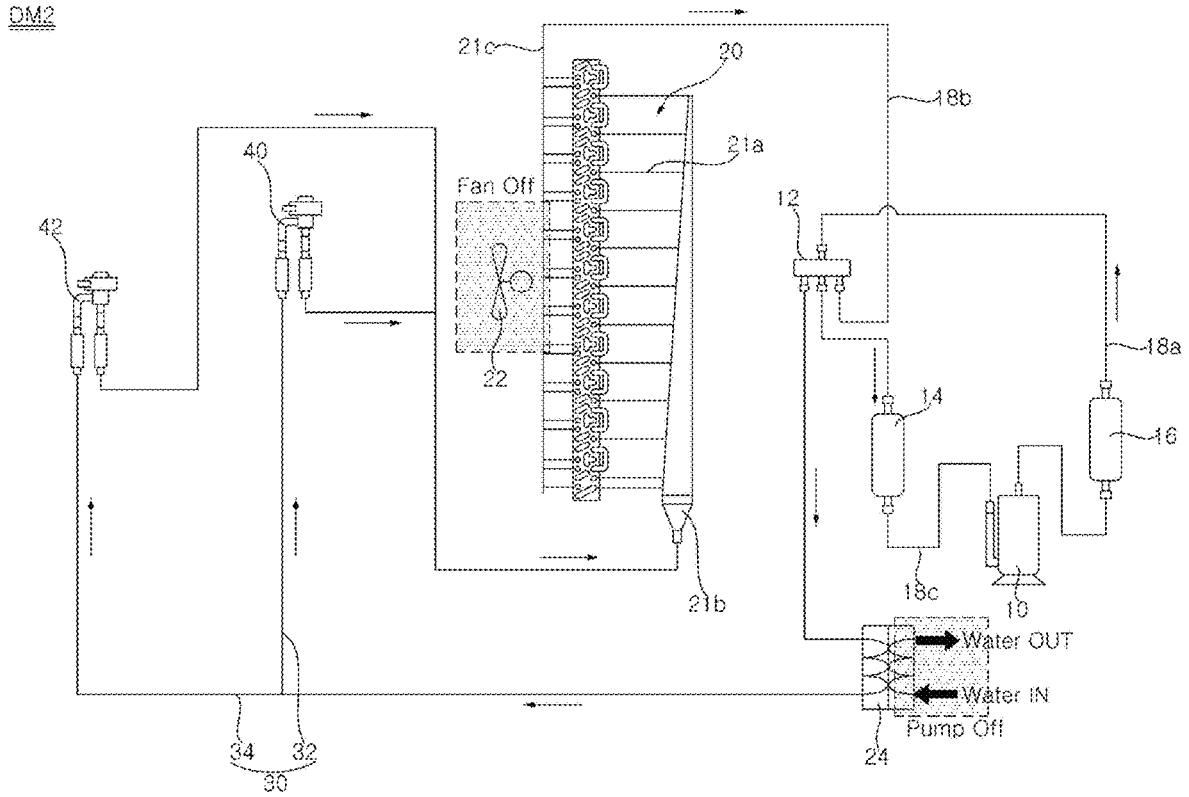
FIG. 5 is a schematic diagram for explaining a refrigerant flow in a second defrosting operation mode of a heat supplier according to an embodiment.

With reference to FIG. 5, the second defrosting operation mode DM2 will be described hereinafter.

In the second defrosting operation mode DM2, by using the refrigerant discharged from the compressor 10, it is possible to remove frost, for example, formed on the first heat exchanger 20 while preventing a temperature decrease of the fluid, such as water, flowing into the second heat exchanger 24.

Referring to FIG. 5, in the second defrosting operation mode DM2, the switching valve 12 may direct the refrigerant discharged from the compressor 10 into the second heat exchanger 24. Operation of the pump may be stopped. Accordingly, the refrigerant discharged from the compressor 10 may flow into the first heat exchanger 20 through the second heat exchanger 24.

The refrigerant discharged from the compressor 10 and flowing to the first heat exchanger 20 through the second heat exchanger 24 experiences a pressure loss while passing through the liquid pipe 30, and consequently, a temperature of refrigerant supplied to the first heat exchanger 20 may be below a certain or predetermined level. When the temperature of the refrigerant supplied to the first heat exchanger 20 is below the predetermined level, frost formed on the first heat exchanger 20 may not be removed. Thus, in order to reduce the pressure loss in refrigerant flowing through the liquid pipe 30, the refrigerant flowing from the second heat exchanger 24 to the first heat exchanger 20 flows through the first liquid pipe 32 and the second liquid pipe 34. That is, the refrigerant flowing from the second heat exchanger 24 to the first heat exchanger 20 flows through a large area of the first liquid pipe 32 and the second liquid pipe 34, and then flows, respectively, into the first expansion valve 40 and the second expansion valve 42, thereby suppressing or reducing the pressure loss. Thus, the temperature of refrigerant supplied to the first heat exchanger 20 may be above the predetermined level.

Thereafter, the first heat exchanger 20 may be defrosted by the refrigerant flowing therethrough.

The heat supplier according to embodiments may have an improved effect in the second defrosting operation mode, compared to a heat supplier with a different structure. That is, the heat supplier according to embodiments exhibits an improved performance in the second defrosting operation mode DM2, compared to a heat supplier of a first comparative example that has the structure of FIG. 6 and a heat supplier of a second comparative example that has the structure of FIG. 7.

A configuration of the heat supplier of FIG. 6 and the heat supplier of FIG. 7 will be briefly described first, and then effects of the heat supplier according to embodiments will be described based on data of FIGS. 8 to 10.

Figure 6:
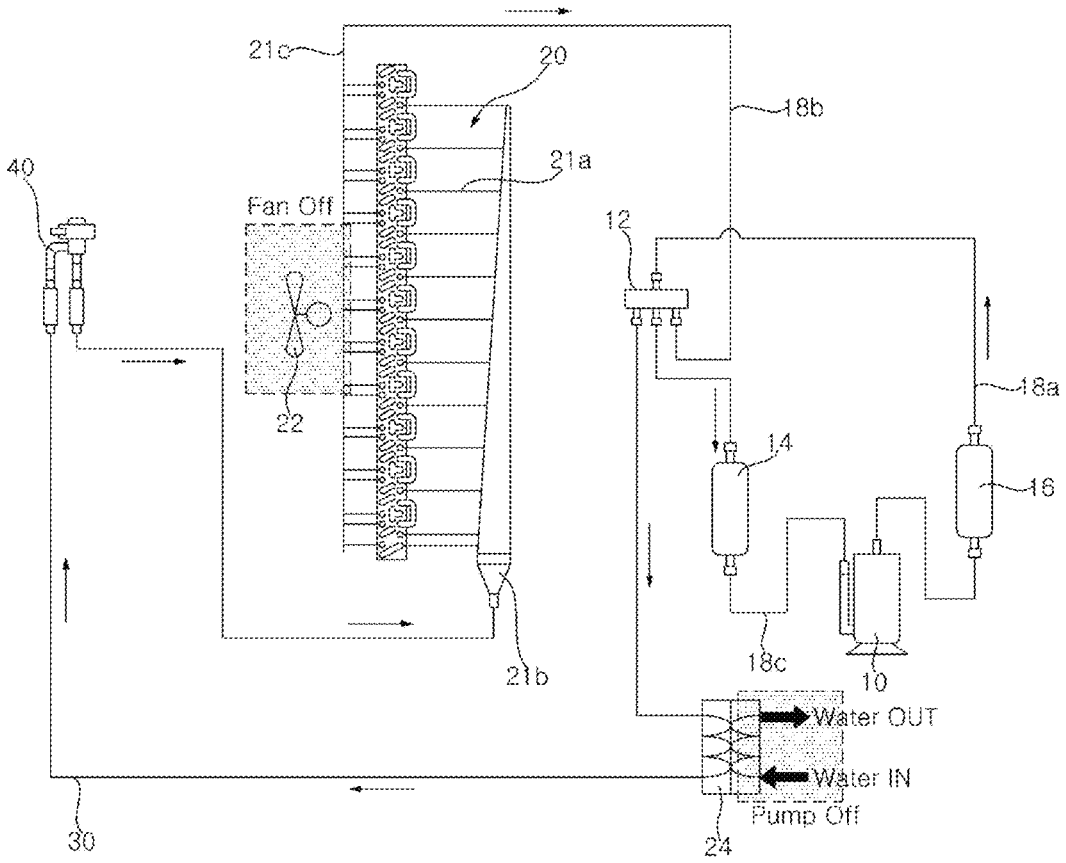
FIG. 6 is a schematic diagram of a heat supplier according to a first comparative example.

Referring to FIG. 6, the heat supplier of the first comparative example has a similar structure as the heat supplier of FIG. 1. However, the heat supplier of the first comparative example only includes one liquid pipe 30 between first heat exchanger 20 and second heat exchanger 24 and one expansion valve 40 disposed at the liquid pipe 30.

The heat supplier of the first comparative example may be operated by opening the same expansion valve 40 in both the heating operation mode HM and the cooling operation mode CM. In this case, there is no difference in the amount of refrigerant between the heating operation mode HM and the cooling operation mode CM.

In addition, when the heat supplier of the first comparative example performs the second defrosting operation mode DM2, the refrigerant that has passed through the second heat exchanger 24 passes only through the one liquid pipe 30 and one expansion valve 40, and a large pressure loss occurs. This is disadvantage in that defrosting of the first heat exchanger 20 cannot be performed because the temperature of the refrigerant supplied to the first heat exchanger 20 is below zero.

Figure 7:
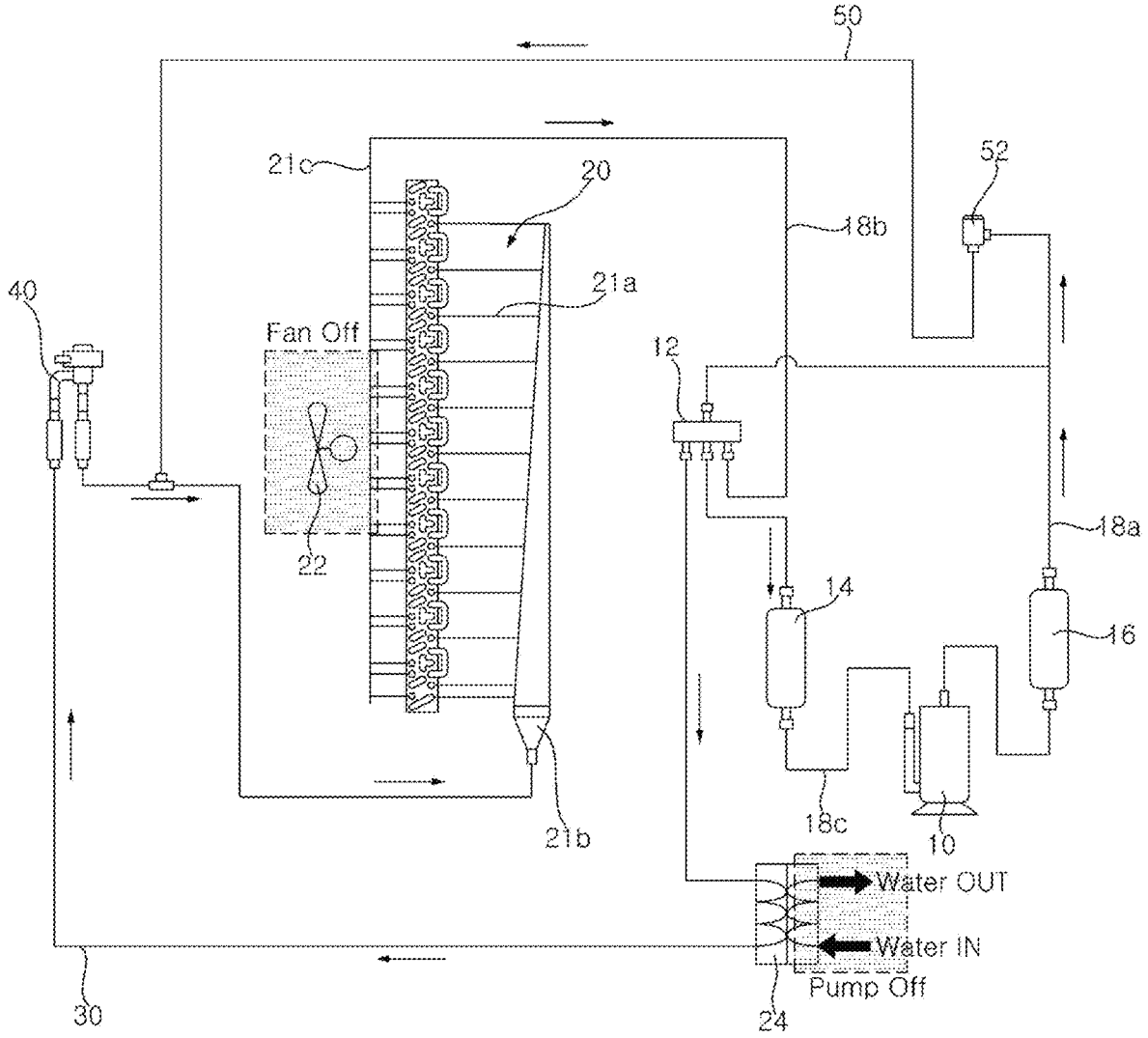
FIG. 7 is a schematic diagram of a heat supplier according to a second comparative example.

Referring to FIG. 7, the heat supplier of the second comparative example differs from the heat supplier of the first comparative example in that a hot gas pipe 50 and a hot gas valve 52 are further provided. The hot gas pipe 50 connects high pressure pipe 18*a* and liquid pipe 30. The hot gas valve 52 may be disposed at the hot gas pipe 50 so as to open and close the hot gas pipe 50.

As for the heat supplier of the second comparative example, in the first defrosting operation mode DM1, similar to the heat supplier according to embodiments, refrigerant discharged from compressor 10 may be delivered to first heat exchanger 20, and the refrigerant discharged from the first heat exchanger 20 may flow through the liquid pipe 30 and expansion valve 40, into second heat exchanger 24 and to the compressor 10. In addition, in the second defrosting operation mode DM2, refrigerant discharged from the compressor 10 may be delivered to the second heat exchanger 24, and a part or portion of the refrigerant discharged from the compressor 10 may be delivered to the hot gas pipe 50.

Thus, as the refrigerant flowing from the first heat exchanger 20 to the second heat exchanger 24 flows through one liquid pipe 30 and one expansion valve 40, a pressure loss may occur, but it may join or come together with high-temperature and high-pressure refrigerant flowing to the hot gas pipe 50 and then flow into the first heat exchanger 20. This may prevent the temperature of refrigerant flowing into the heat exchanger 20 from falling below a certain or predetermined level.

Figure 8:
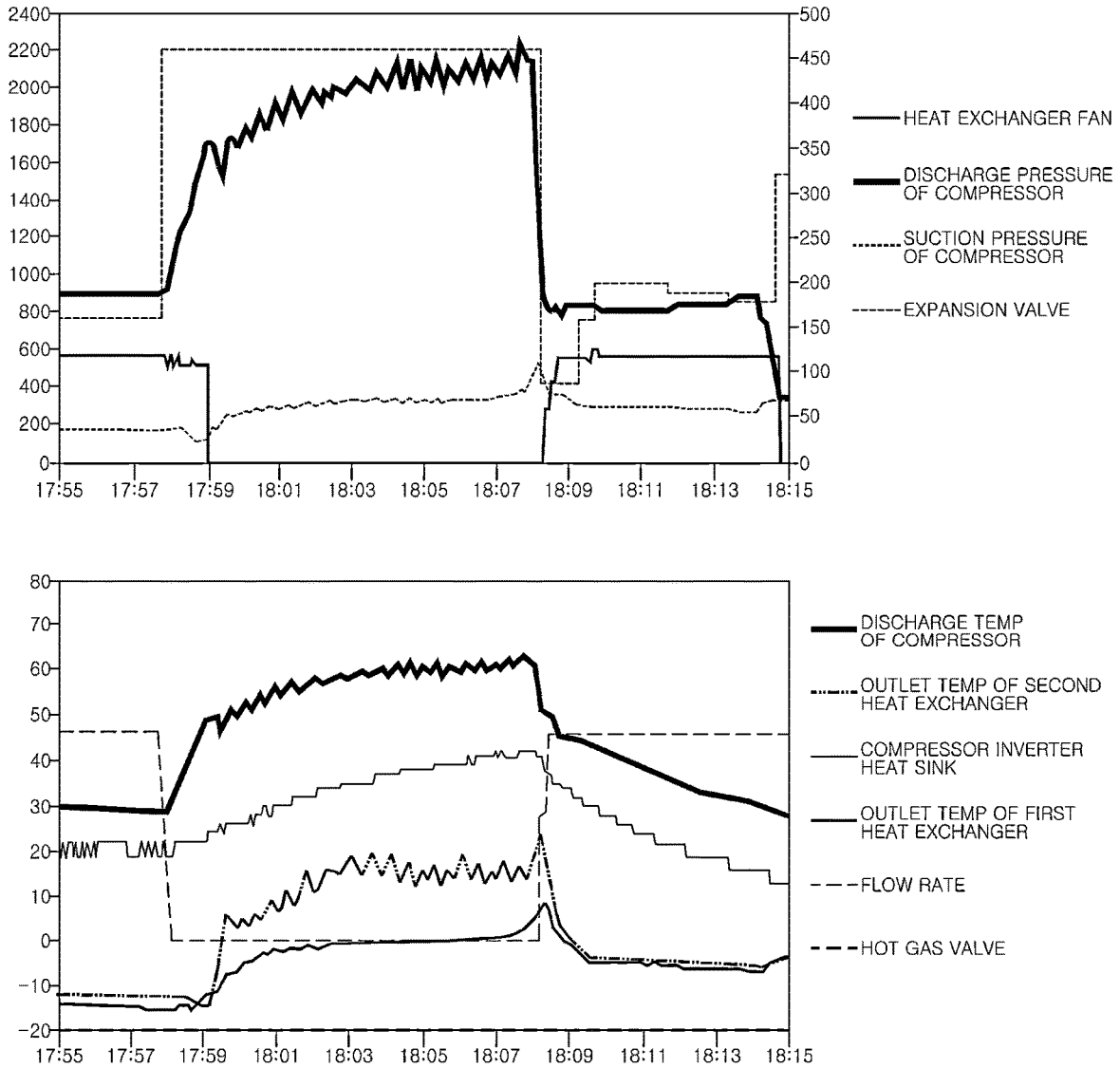
FIG. 8 is a graph showing data measured during a second defrosting operation mode of a heat supplier according to an embodiment.
Figure 9:
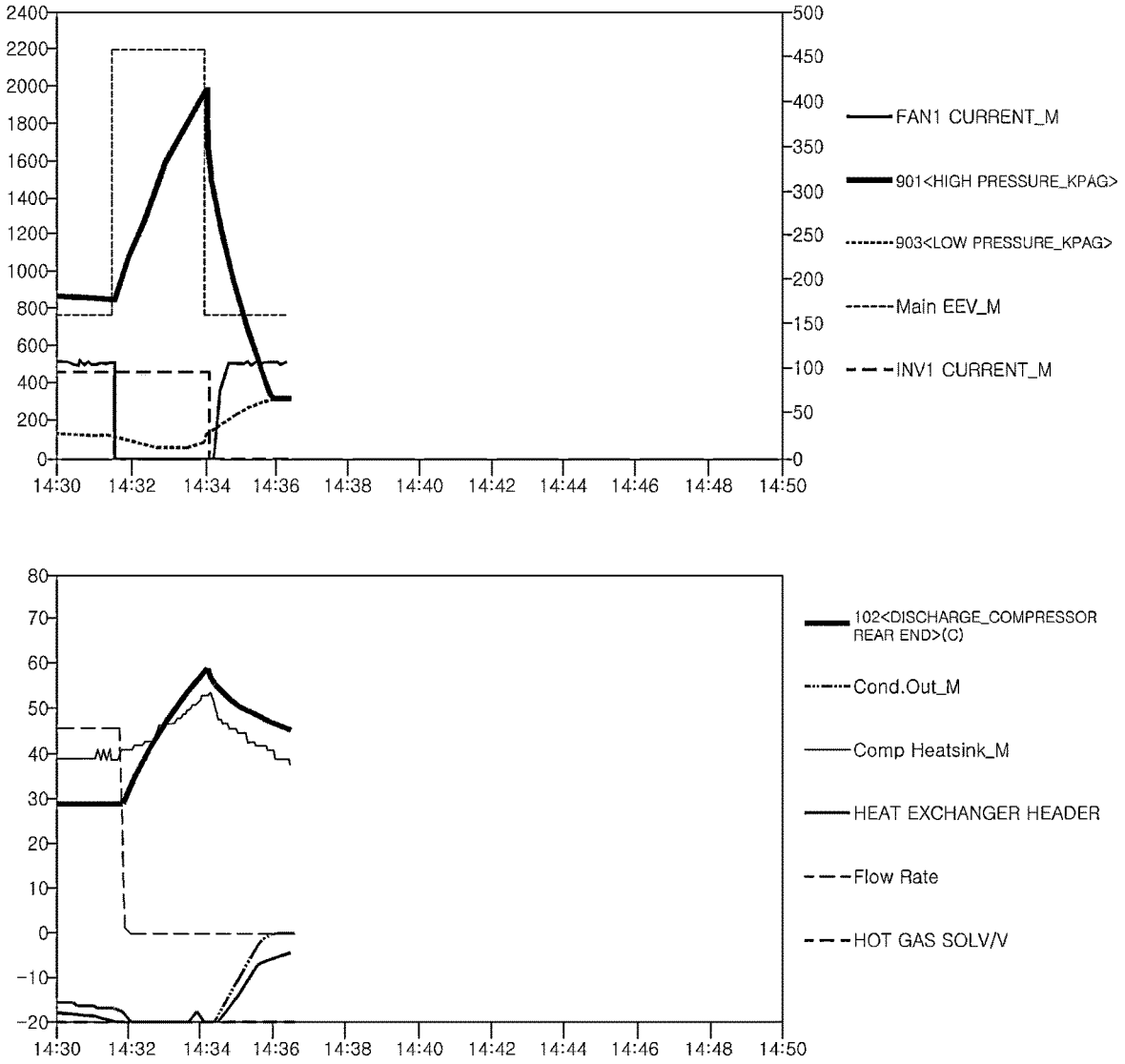
FIG. 9 is a graph showing data measured during a second defrosting operation mode of a heat supplier according to a first comparative example.
Figure 10:
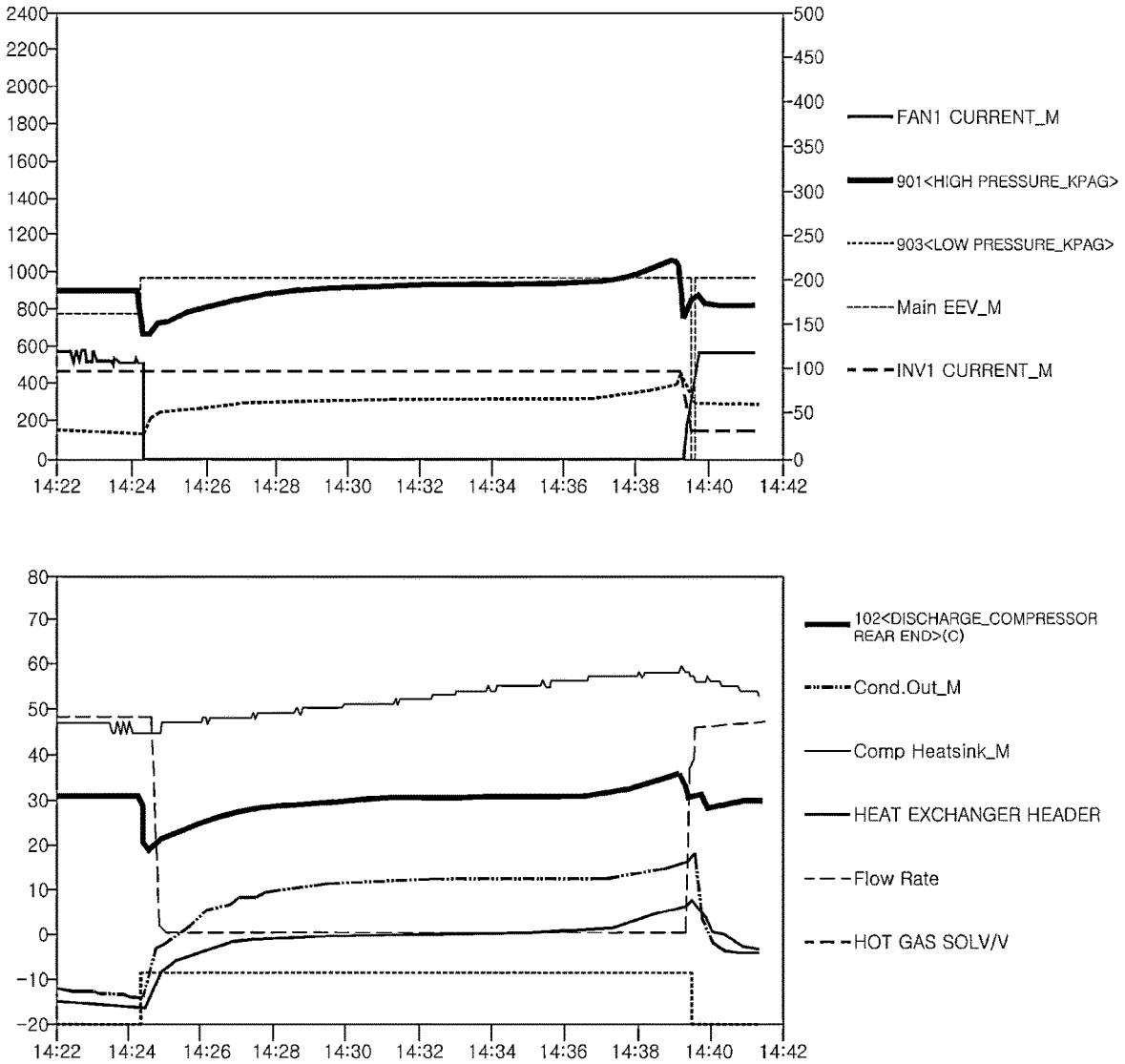
FIG. 10 is a graph showing data measured during a second defrosting operation mode of a heat supplier according to a second comparative example.

Referring to FIGS. 8 to 10, these graphs show temperature and pressure in components of the heat supplier according to embodiments that performs the second defrosting operation mode DM2 and temperature and pressure in components of the heat suppliers of the first comparative example and the second comparative example. Referring to FIG. 8, as for the heat supplier according to embodiments, it can be seen that a discharge pressure and discharge temperature of the compressor 10 increase as the compressor 10 operates. In addition, when the compressor 10 operates, a temperature of refrigerant introduced into the first heat exchanger 20 is 0° C. or higher and then gradually increases. It can be seen that a temperature of refrigerant discharged from the first heat exchanger 20 is around −10° C. and then gradually increases.

Accordingly, as an inlet temperature of the refrigerant flowing through the first heat exchanger 20 gradually increases from above 0° C., it is possible to defrost the first heat exchanger 20. Further, as the discharge temperature and discharge pressure of the compressor 10 increase, it is possible to reduce the time to perform the second defrosting operation mode DM2.

By contrast, referring to FIG. 9, as for the heat supplier according to the first comparative example, a temperature of refrigerant introduced into the first heat exchanger 20 is below 0° C., making it unable to defrost the first heat exchanger 20. That is, as a pressure loss in the liquid pipe 30 and the expansion valve 40 is excessive, the temperature of refrigerant detected or measured at an inlet side of the first heat exchanger 20 is −10° C. or lower.

Referring to FIG. 10, as for the heat supplier according to the second comparative example, it can be seen that a temperature of refrigerant introduced into the first heat exchanger 20 is 0° C. or higher and then gradually increases to above 10° C. In addition, a temperature of refrigerant discharged from the first heat exchanger 20 is below 0° C. at the beginning, but the temperature gradually increases to above 0° C. as the compressor 10 operates. However, as for the heat supplier according to the second comparative example, the temperature and pressure of the refrigerant discharged from the compressor are less than those of the heat supplier according to embodiments. It can be seen that the average pressure of the refrigerant discharged from the compressor 10 of the heat supplier according to embodiments is 1800 kPa or more, as shown in FIG. 8, but the average pressure of the refrigerant discharged from the compressor of the heat supplier of the second comparative example is about 900 kPa. Therefore, it can be seen that the heat supplier according to embodiments requires less time to perform the second defrosting operation mode DM2 compared to the heat supplier according to the second comparative example.

Figure 11:
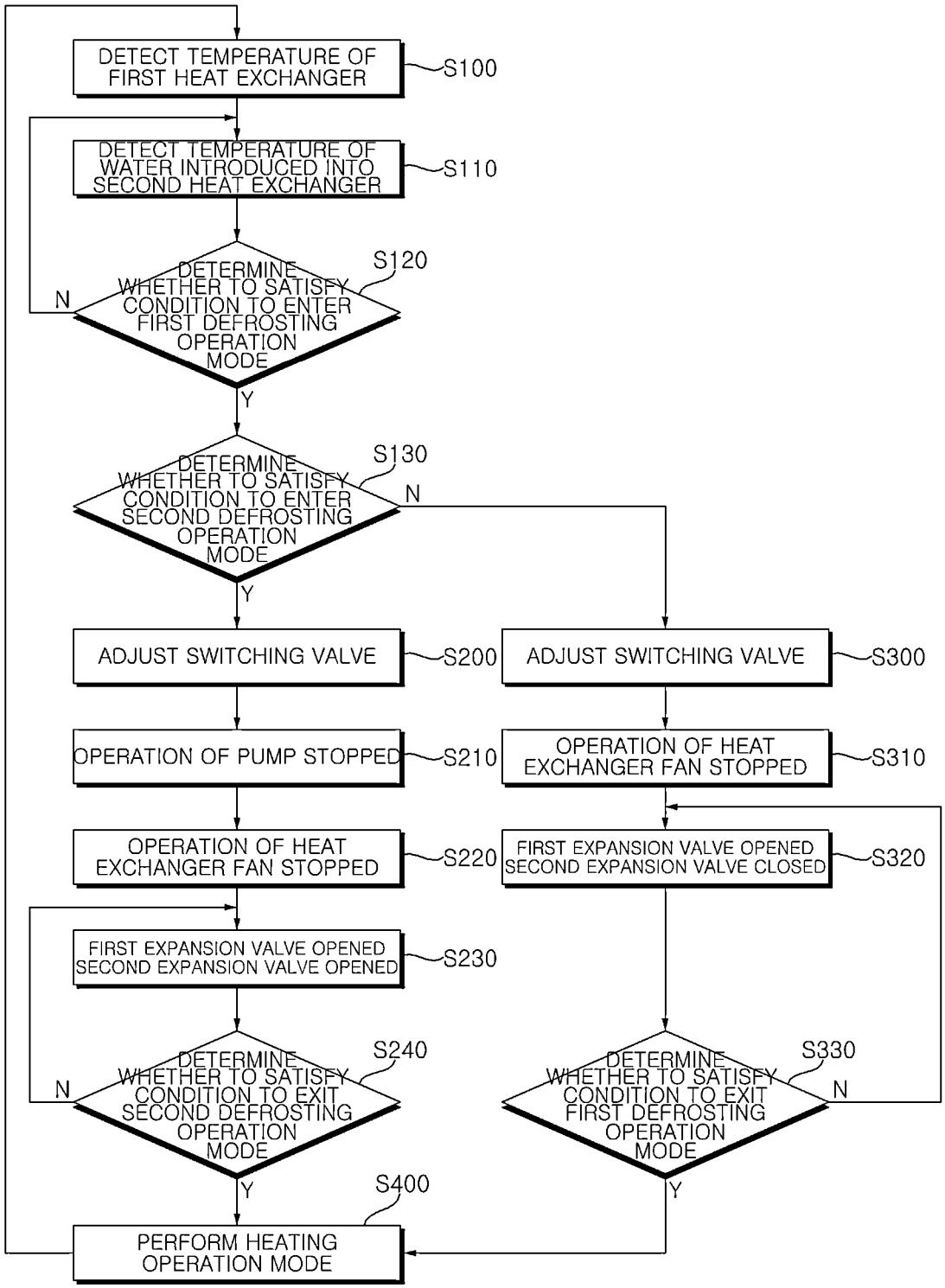
FIG. 11 is a flowchart of a method for controlling a heat supplier according to an embodiment.

Hereinafter, a method for controlling a heat supplier according to embodiments will be described with reference to FIG. 11.

First, a temperature of the first heat exchanger 20 is detected (s100) and a temperature of the second heat exchanger 24 is detected (s110). The temperature of the first heat exchanger 20 and the temperature of the second heat exchanger 24 may be detected during a heating operation mode HM. Alternatively, the temperature of the first heat exchanger 20 and the temperature of the second heat exchanger 24 may be detected at a start of the heating operation mode HM.

At s100, the temperature of the first heat exchanger 20 may be detected based on a discharge pressure and suction pressure of the compressor 10. Alternatively, the temperature of the first heat exchanger 20 may be detected via a separate temperature sensor (25*b*, refer to FIG. 1).

At s110, the temperature of the second heat exchanger 24 may be detected based on a temperature of a fluid, such as water, introduced into the second heat exchanger 24. Alternatively, the temperature of the second heat exchanger 24 may be detected via a separate temperature sensor (25*b*, refer to FIG. 1).

Thereafter, whether a condition to enter a defrosting operation mode is satisfied is determined (s120). Whether the condition to enter the defrosting operation mode is satisfied may be determined based on the temperature of the first heat exchanger 20.

At s120, whether the condition to enter the defrosting operation mode is satisfied may be determined based on the temperature of the first heat exchanger 20 being a first set or predetermined temperature or lower. That is, when the temperature of the first heat exchanger 20 is less than or equal to the first predetermined temperature, it is determined that the condition to enter the defrosting operation mode is satisfied. However, when the temperature of the first heat exchanger 20 exceeds the first predetermined temperature, as it does not satisfy the condition to enter the defrosting operation mode, the detecting of the temperature of the first heat exchanger 20 (s100) and the detecting of the second heat exchanger 24 (s110) may be repeatedly carried out.

When it is determined that the condition to enter the defrosting operation mode is satisfied, a first defrosting operation mode DM1 or a second defrosting operation mode DM2 may be performed. Then, whether a mode to enter the second defrosting operation mode DM2 is satisfied is additionally determined (s130).

At s130, whether the condition to enter the second defrosting operation mode DM2 is satisfied may be determined based on the temperature of the fluid introduced into the second heat exchanger 24. When the temperature of the fluid introduced into the second heat exchanger 24 is less than or equal to a second set or predetermined temperature, it is determined that the condition to enter the second defrosting operation mode DM2 is satisfied.

If the first defrosting operation mode DM1 is performed when the temperature of the fluid introduced into the second heat exchanger 24 is less than or equal to the second predetermined temperature, the temperature of the fluid discharged to the second heat exchanger 24 becomes too low, causing a pipe through which the fluid flows to rupture or burst due to freezing. Thus, when the temperature of the fluid introduced into the second heat exchanger 24 is less than or equal to the second predetermined temperature, as it satisfies the condition to enter the second defrosting operation mode DM2, the second defrosting operation mode DM2 may be performed. Based on the temperature detected in the first heat exchanger 20 and the temperature detected in the second heat exchanger 24, the first defrosting operation mode DM1 in which the refrigerant discharged from the compressor 10 is delivered to the first heat exchanger 20 or the second defrosting operation mode DM2 in which the refrigerant discharged from the compressor 10 is delivered to the second heat exchanger 24 may be performed.

When the second defrosting operation mode DM2 is performed, the switching valve 12 is adjusted (s200). When the second defrosting operation mode DM2 is performed, the switching valve 12 is adjusted to direct the refrigerant discharged from the compressor 10 into the second heat exchanger 24. However, in the heating operation mode HM, the switching valve 12 may be adjusted to maintain the flow of the refrigerant discharged from the compressor 10 into the second heat exchanger 24.

When the second defrosting operation mode DM2 is performed, operation of the pump (not shown) is stopped (s220). Accordingly, it is possible to minimize heat exchange between the refrigerant flowing through the second heat exchanger 24 and water. In addition, operation of the heat exchanger fan 22 disposed at the first heat exchanger 20 is stopped (s220).

When the second defrosting operation mode DM2 is performed, the first expansion valve 40 and the second expansion valve 42 are opened (s230). The first expansion valve 40 and the second expansion valve 42 are opened so that the refrigerant flows into both the first liquid pipe 32 and the second liquid pipe 34. Accordingly, it is possible to reduce the pressure loss of refrigerant caused when the refrigerant flows from the second heat exchanger 24 to the first heat exchanger 20. As the second defrosting operation mode DM2 is carried out, frost, for example, formed on the first heat exchanger 20 may be removed.

Thereafter, whether a condition to exit the second defrosting operation mode DM2 is satisfied is determined (s240). Whether the condition to exit the second defrosting operation mode is satisfied may be determined based on a temperature of an outlet side of the first heat exchanger 20 in a direction of refrigerant flowing through the first heat exchanger 20. The outlet side of the first heat exchanger 20 during the second defrosting operation mode DM2 may be a gas pipe disposed between the first heat exchanger 20 and the compressor 10. That is, referring to FIG. 5, the outlet side of the first heat exchanger 20 may be a region where the first gas pipe 18*b* is disposed during the second defrosting operation mode DM2.

Whether the condition to exit the second defrosting operation mode DM2 is satisfied may be determined based on an elapsed time after initiation of the second defrosting operation mode DM2. Whether the condition to exit the second defrosting operation mode DM2 is satisfied may be determined based on the temperature at the outlet side of the first heat exchanger 20 in the direction of the refrigerant flowing through the first heat exchanger 20 or the time elapsed after the initiation of the second defrosting operation mode DM2.

That is, when the temperature of the gas pipe connected to the first heat exchanger 20 is greater than or equal to a third set or predetermined temperature or when the elapsed time after the initiation of the second defrosting operation mode DM2 is greater than a first set or predetermined time, it is determined that the condition to exit the second defrosting operation mode DM2 is satisfied. When the condition to exit the second defrosting operation mode DM2 is satisfied, the heating operation mode HM may be performed (s400). However, when the condition to exit the second defrosting operation mode DM2 is not satisfied, the second defrosting operation mode DM2 may be continued.

When the condition to exit the second defrosting operation mode DM2 is not satisfied, the first defrosting operation mode DM1 may be performed. When the first defrosting operation mode DM1 is performed, the switching valve 12 is adjusted (s300). During the first defrosting operation mode DM1, the switching valve 12 is adjusted so that the refrigerant discharged from the compressor 10 flows into the first heat exchanger 20.

When the heating operation mode HM is previously performed, the switching valve 12 is adjusted so that the refrigerant discharged from the compressor 10 and flowing to the second heat exchanger 24 flows into the first heat exchanger 20. When the first defrosting operation mode DM1 is performed, the pump may be kept in operation.

When the first defrosting operation mode DM1 is performed, operation of the heat exchanger fan 22 disposed at the first heat exchanger 20 is stopped (s310). When the first defrosting operation mode DM1 is performed, the first expansion valve 40 is opened and the second expansion valve 42 is closed (s320). The first defrosting operation mode DM1 may be performed while the heating operation mode HM is performed, the first expansion valve 40 may be kept open and the second expansion valve 42 may be kept closed in the heating operation mode HM. As the first defrosting operation mode DM1 is carried out, frost, for example, formed on the first heat exchanger 20 may be removed.

Thereafter, whether a condition to exit the first defrosting operation mode DM1 is satisfied is determined (s330). Whether the condition to exit the first defrosting operation mode DM1 is satisfied may be determined based on a temperature of the outlet side of the first heat exchanger 20 in the direction of refrigerant flowing through the first heat exchanger 20.

During the first defrosting operation mode DM1, the outlet side of the first heat exchanger 20 may be the liquid pipe 30 disposed between the first heat exchanger 20 and the compressor 10. Referring to FIG. 4, the outlet side of the first heat exchanger 20 may be a region where the liquid pipe 30 is disposed during the first defrosting operation mode DM1.

Whether the condition to exit the first defrosting operation mode DM1 is satisfied may be determined based on an elapsed time after initiation of the first defrosting operation mode DM1. Whether the condition to exit the first defrosting operation mode DM1 is satisfied may be determined based on the temperature at the outlet side of the first heat exchanger 20 in the direction of the refrigerant flowing through the first heat exchanger 20 or the time elapsed after the initiation of the first defrosting operation mode DM1.

That is, when the temperature of the liquid pipe connected to the first heat exchanger 20 is greater than or equal to a fourth set or predetermined temperature, or when the elapsed time after the initiation of the first defrosting operation mode DM1 is greater than a second set or predetermined time, it is determined that the condition to exit the first defrosting operation mode DM1 is satisfied.

When the first defrosting operation mode DM1 is satisfied, the heating operation mode HM may be performed (s400). However, when the condition to exit the first defrosting operation mode DM1 is not satisfied, the first defrosting operation mode DM1 may be continued.

Embodiments disclosed herein provide a heat supplier that may control an amount of refrigerant supplied to any of heat exchangers with different capacity according to an operation mode.

Embodiments disclosed herein also provide a heat supplier that may perform defrosting of a first heat exchanger while preventing a fluid, such as water, introduced into a second heat exchanger from cooling even in an extremely low-temperature environment.

Embodiments disclosed herein further provide a method for controlling a heat supplier that allows the heat supplier to defrost only a first heat exchanger or simultaneously defrost the first heat exchanger and a second heat exchanger depending on temperature condition.

Advantages are not limited to the advantages described, and other advantages not stated will be clearly understood by those skilled in the art from the following description.

Embodiments disclosed herein provide a heat supplier that may include a compressor configured to compress a refrigerant; a first heat exchanger configured to exchange heat between air and the refrigerant; a second heat exchanger configured to exchange heat between a fluid, such as water, and the refrigerant; a switching valve to direct the refrigerant discharged from the compressor into the first heat exchanger or the second heat exchanger; a first liquid pipe to connect the first heat exchanger and the second heat exchanger; a second liquid pipe connected in parallel to the first liquid pipe so as to connect the first heat exchanger and the second heat exchanger; a first expansion valve disposed at the first liquid pipe and configured to expand refrigerant flowing therethrough; and a second expansion valve disposed at the second liquid pipe and configured to expand refrigerant flowing therethrough. A size of an aperture of the second expansion valve may be greater than a size of an aperture of the first expansion valve, thereby adjusting the flow rate of refrigerant according to operation mode.

The heat supplier may operate in a cooling mode in which the refrigerant discharged from the compressor is delivered to the first heat exchanger or in a heating mode in which the refrigerant discharged from the compressor is delivered to the second heat exchanger. The first liquid pipe and the second liquid pipe may be selectively opened in the cooling mode and the heating mode, thereby adjusting a flow rate of refrigerant according to an operation mode.

In the cooling mode, the second expansion valve may close the second liquid pipe, and the first expansion valve may open the first liquid pipe. Thus, the second expansion valve having a larger aperture size may be opened when the refrigerant discharged from the compressor flows to the first heat exchanger with a large capacity.

In the heating mode, the first expansion valve may close the first liquid pipe, and the second expansion valve may open the second liquid pipe. Thus, the first expansion valve having a smaller aperture size may be opened when the refrigerant discharged from the compressor flows to the second heat exchanger with a relatively small capacity.

The heat supplier may further include a pump to cause a flow of water flowing through the second heat exchanger. Operation of the pump may be stopped when both the first liquid pipe and the second liquid pipe are opened, thereby minimizing heat exchange with the refrigerant in the second heat exchanger.

In a case in which a temperature of the first heat exchanger is less than or equal to a first set or predetermined temperature, the switching valve may be adjusted to allow the refrigerant discharged from the compressor to flow into the first heat exchanger and the first expansion valve may be opened, so as to perform a defrosting operation.

In a case in which the temperature of the first heat exchanger is less than or equal to the first set temperature, operation of a heat exchanger fan that causes an air flow into the first heat exchanger may be stopped, so as to perform the defrosting operation.

The heat supplier may further include a temperature sensor to detect a temperature of water introduced into the second heat exchanger. In a case in which the temperature of water introduced into the second heat exchanger is less than or equal to a second set or predetermined temperature, the switching valve may be adjusted to allow the refrigerant discharged from the compressor to flow into the second heat exchanger, and both the first expansion valve and the second expansion valve may be opened, thereby performing defrosting of the first heat exchanger while preventing the water of the second heat exchanger from cooling.

In a case in which the temperature of water introduced into the second heat exchanger is less than or equal to the second set temperature, operation of a pump that supplies water to the second heat exchanger may be stopped, thereby preventing the water of the second heat exchanger from cooling. In a case in which the temperature of water introduced into the second heat exchanger is less than or equal to the second set temperature, operation of a heat exchanger fan that causes an air flow into the first heat exchanger may be stopped, thereby performing defrosting of the first heat exchanger.

A flow rate of the refrigerant flowing through the second expansion valve may be 1.2 times to 2 times greater than a flow rate of the refrigerant flowing through the first expansion valve, so as to correspond to a change in the flowing refrigerant.

Embodiments disclosed herein provide a method for controlling a heat supplier that may include detecting a temperature of a first heat exchanger configured to exchange heat between air and refrigerant; detecting a temperature of a fluid, such as water, introduced into a second heat exchanger configured to exchange heat between the fluid, such as water, and refrigerant; and performing, based on the temperature detected in the first heat exchanger and the temperature detected in the second heat exchanger, a first defrosting operation mode in which a refrigerant discharged from a compressor is delivered to the first heat exchanger or a second defrosting operation mode in which the refrigerant discharged from the compressor is delivered to the second heat exchanger. Thus, the frosting mode may be differently performed based on the temperature of the first heat exchanger and the temperature of water introduced into the second heat exchanger.

In a case in which the temperature detected in the first heat exchanger is less than or equal to a first set or predetermined temperature and the temperature of water introduced into the second heat exchanger is less than or equal to a second set or predetermined temperature, a switching valve may be adjusted to allow the refrigerant discharged from the compressor to flow into the second heat exchanger, so as to perform the second defrosting operation mode. Thus, when the temperature of water is below a certain or predetermined level, the first heat exchanger may be defrosted while preventing the water of the second heat exchanger from cooling.

Performing the second defrosting operation mode may include adjusting a first expansion valve disposed at a first liquid pipe and a second expansion valve disposed at a second liquid pipe, such that the first liquid pipe and the second liquid pipe, which connect the first heat exchanger and the second heat exchanger in parallel, may be opened. Accordingly, a flow rate of refrigerant flowing from the second heat exchanger to the first heat exchanger may be increased.

Performing the second defrosting operation mode may include stopping operation of a pump that supplies water to the second heat exchanger and stopping operation of a heat exchanger fan that causes an air flow into the first heat exchanger. Accordingly, the second defrosting operation mode may be ended under a certain or predetermined condition.

The method may further include determining whether a condition to exit the second defrosting operation mode is satisfied to end the second defrosting operation mode. Whether the condition to exit the second defrosting operation mode is satisfied may be determined based on a temperature at an outlet side of the first heat exchanger in a direction of the refrigerant flowing through the first heat exchanger.

In a case in which the temperature detected in the first heat exchanger is less than or equal to a first set or predetermined temperature and the temperature of water introduced into the second heat exchanger exceeds a second set or predetermined temperature, a switching valve may be adjusted to allow the refrigerant discharged from the compressor flows into the first heat exchanger, so as to perform the first defrosting operation mode. Performing the first defrosting operation mode may include stopping operation of a heat exchanger fan that causes an air flow into the first heat exchanger. Thus, when the water introduced into the second heat exchanger is not a certain or predetermined level of low-temperature water, defrosting of the first heat exchanger may be intensively performed.

Performing the first defrosting operation mode may include adjusting a first expansion valve disposed at a first liquid pipe and a second expansion valve disposed at a second liquid pipe, such that only one of the first liquid pipe and the second liquid pipe, which connect the first heat exchanger and the second heat exchanger in parallel, may be opened. As the defrosting operation is often performed during the heating operation, the first expansion valve and the second expansion valve may be adjusted in conjunction with the heating operation.

Embodiments disclosed herein provide a heat supplier that may include a compressor configured to compress a refrigerant; a first heat exchanger configured to exchange heat between air and the refrigerant; a second heat exchanger configured to exchange heat between a fluid, such as water, and the refrigerant; a heat exchanger fan to cause an air flow into the first heat exchanger; a switching valve to direct the refrigerant discharged from the compressor into the first heat exchanger or the second heat exchanger; a first liquid pipe to connect the first heat exchanger and the second heat exchanger; a second liquid pipe connected in parallel to the first liquid pipe so as to connect the first heat exchanger and the second heat exchanger; a first expansion valve disposed at the first liquid pipe and configured to expand refrigerant flowing therethrough; and a second expansion valve disposed at the second liquid pipe and configured to expand refrigerant flowing therethrough. In a case in which a temperature of water introduced into the second heat exchanger is less than or equal to a set or predetermined temperature, the first expansion valve and the second expansion valve may be adjusted so that the refrigerant discharged from the compressor flows from the second heat exchanger to the first heat exchanger, and the refrigerant flowing from the second heat exchanger and the first heat exchanger may flow, respectively, into the first liquid pipe and the second liquid pipe. Accordingly, both the second heat exchanger and the first heat exchanger may be defrosted according to temperature condition.

In a case in which the temperature of water introduced into the second heat exchanger is less than or equal to the set or predetermined temperature, operation of a pump that supplies the water to the second heat exchanger may be stopped.

A heat supplier according to embodiments disclosed herein has at least one or more of the following advantages.

First, as two expansion valves having different aperture sizes are arranged in parallel and the expansion valves are selectively opened and closed according to an operation mode, it is possible to adjust a flow rate of refrigerant even when two heat exchangers with different capacity are used.

Second, as an expansion valve is disposed at each of liquid pipes connected in parallel, the heat supplier may perform various operation modes.

Third, it is possible to perform defrosting of a first heat exchanger while preventing water introduced into a second heat exchanger from cooling in an extremely low-temperature environment.

Advantages may not be limited to the advantages described above, and other advantages not mentioned will be clearly understood by those skilled in the art from the claims.

It will be apparent that, although embodiments have been shown and described above, the embodiments are not limited to the above-described specific embodiments, and various modifications and variations can be made by those skilled in the art without departing from the scope of the appended claims. Thus, it is intended that the modifications and variations should not be understood independently of the technical spirit or prospect.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat supplier, comprising:

a compressor that compresses a refrigerant;

a first heat exchanger that exchanges heat between air and the refrigerant;

a second heat exchanger that exchanges heat between a fluid and the refrigerant;

a switching valve that directs the refrigerant discharged from the compressor into the first heat exchanger or the second heat exchanger;

a first liquid pipe that connects the first heat exchanger and the second heat exchanger;

a second liquid pipe connected in parallel to the first liquid pipe so as to connect the first heat exchanger and the second heat exchanger;

a first expansion valve disposed at the first liquid pipe and configured to expand the refrigerant flowing therethrough;

a second expansion valve disposed at the second liquid pipe and configured to expand the refrigerant flowing therethrough; and a temperature sensor to detect a temperature of water introduced into the second heat exchanger, wherein a size of an aperture of the second expansion valve is greater than a size of an aperture of the first expansion valve, wherein, in case that the temperature of water introduced into the second heat exchanger is less than or equal to a second set temperature, the switching valve is configured to be adjusted to allow the refrigerant discharged from the compressor to flow into the second heat exchanger, and both the first expansion valve and the second expansion valve are configured to be opened, wherein, in case that the temperature of water introduced into the second heat exchanger is less than or equal to the second set temperature, operation of a pump that supplies water to the second heat exchanger is configured to be stopped, and wherein, in case that the temperature of water introduced into the second heat exchanger is less than or equal to the second set temperature, operation of a heat exchanger fan that causes an air flow into the first heat exchanger is configured to be stopped.

2. The heat supplier of claim 1, wherein the heat supplier operates in a cooling mode in which the refrigerant discharged from the compressor is delivered to the first heat exchanger or in a heating mode in which the refrigerant discharged from the compressor is delivered to the second heat exchanger, and wherein the first liquid pipe and the second liquid pipe are selectively opened in the cooling mode and the heating mode.

3. The heat supplier of claim 2, wherein, in the cooling mode, the second expansion valve closes the second liquid pipe, and the first expansion valve opens the first liquid pipe.

4. The heat supplier of claim 2, wherein, in the heating mode, the first expansion valve closes the first liquid pipe, and the second expansion valve opens the second liquid pipe.

5. The heat supplier of claim 1, further comprising a pump that pumps the fluid through the second heat exchanger, wherein operation of the pump is stopped when both the first liquid pipe and the second liquid pipe are opened.

6. The heat supplier of claim 1, wherein, in case in which a temperature of the first heat exchanger is less than or equal to a predetermined temperature, the switching valve is adjusted to allow the refrigerant discharged from the compressor to flow into the first heat exchanger, and the first expansion valve is opened.

7. The heat supplier of claim 6, wherein, in a case in which the temperature of the first heat exchanger is less than or equal to the predetermined temperature, operation of a heat exchanger fan that causes an air flow into the first heat exchanger is stopped.

8. The heat supplier of claim 1, wherein a flow rate of the refrigerant flowing through the second expansion valve is 1.2 times to 2 times greater than a flow rate of the refrigerant flowing through the first expansion valve.

9. A method for controlling a heat supplier, the method comprising:

detecting a temperature of a first heat exchanger configured to exchange heat between air and a refrigerant;

detecting a temperature of a fluid introduced into a second heat exchanger configured to exchange heat between the fluid and the refrigerant; and performing, based on the temperature detected in the first heat exchanger and the temperature detected in the second heat exchanger, a first defrosting operation mode in which the refrigerant discharged from a compressor is delivered to the first heat exchanger or a second defrosting operation mode in which the refrigerant discharged from the compressor is delivered to the second heat exchanger, wherein, in case that the temperature detected in the first heat exchanger is less than or equal to a first set temperature and the temperature of water introduced into the second heat exchanger is less than or equal to a second set temperature, a switching valve is configured to be adjusted to allow the refrigerant discharged from the compressor to flow into the second heat exchanger, so as to perform the second defrosting operation mode, wherein performing the second defrosting operation mode comprises adjusting a first expansion valve disposed at a first liquid pipe and a second expansion valve disposed at a second liquid pipe, such that the first liquid pipe and the second liquid pipe, which connect the first heat exchanger and the second heat exchanger in parallel, are opened, and wherein performing the second defrosting operation mode comprises stopping operation of a pump that supplies water to the second heat exchanger and stopping operation of a heat exchanger fan that causes an air flow into the first heat exchanger.

10. The method of claim 9, further comprising determining whether a condition to exit the second defrosting operation mode is satisfied to end the second defrosting operation mode, wherein whether the condition to exit the second defrosting operation mode is satisfied is determined based on a temperature at an outlet side of the first heat exchanger in a direction of the refrigerant flowing through the first heat exchanger.

11. The method of claim 9, wherein, in a case in which the temperature detected in the first heat exchanger is less than or equal to a first predetermined temperature and the temperature of fluid introduced into the second heat exchanger exceeds a second predetermined temperature, a switching valve is adjusted to allow the refrigerant discharged from the compressor to flow into the first heat exchanger, so as to perform the first defrosting operation mode, and wherein the performing of the first defrosting operation mode comprises stopping operation of a heat exchanger fan that causes an air flow into the first heat exchanger.

12. The method of claim 11, wherein the performing of the first defrosting operation mode comprises adjusting a first expansion valve disposed at a first liquid pipe and a second expansion valve disposed at a second liquid pipe, such that only one of the first liquid pipe and the second liquid pipe, which connect the first heat exchanger and the second heat exchanger in parallel, is opened.

* * * * *